US007721890B2

(12) United States Patent
Neidhardt

(10) Patent No.: US 7,721,890 B2
(45) Date of Patent: May 25, 2010

(54) PACKAGE SYSTEM FOR A POWDERY, GRANULAR, PASTE-LIKE OR LIQUID STERILE PRODUCT

(75) Inventor: Astrid Neidhardt, Zürich (CH)

(73) Assignee: Straumann Holding AG, Basel (CH)

( * ) Notice: Subject to any disclaimer, the term of this patent is extended or adjusted under 35 U.S.C. 154(b) by 612 days.

(21) Appl. No.: 11/246,352

(22) Filed: Oct. 7, 2005

(65) Prior Publication Data

US 2006/0076256 A1 Apr. 13, 2006

(30) Foreign Application Priority Data

Oct. 8, 2004 (EP) ..... 04024011

(51) Int. Cl.
*A61B 19/00* (2006.01)
*B65D 1/34* (2006.01)

(52) U.S. Cl. ..... 206/438; 206/528; 206/557

(58) Field of Classification Search ..... 206/438, 206/63.5, 528, 530, 557, 461; 220/23.87, 220/23.88

See application file for complete search history.

(56) References Cited

U.S. PATENT DOCUMENTS 4,482,053 A 11/1984 Alpern et al.
4,697,703 A * 10/1987 Will ..... 206/438
4,750,619 A 6/1988 Cohen et al.
5,290,558 A * 3/1994 O'Leary et al. ..... 424/422
5,590,778 A 1/1997 Dutchik et al.
5,720,391 A 2/1998 Dohm et al.
6,044,650 A * 4/2000 Cook et al. ..... 62/130
6,509,031 B1 * 1/2003 Miller et al. ..... 424/443
6,622,864 B1 * 9/2003 Debbs et al. ..... 206/438
6,830,149 B2 12/2004 Merboth et al.
6,889,839 B1 5/2005 Rosten et al.
2003/0168370 A1 * 9/2003 Merboth et al. ..... 206/438

FOREIGN PATENT DOCUMENTS

WO WO 87/05278 A 9/1987

OTHER PUBLICATIONS

European Search Report dated Mar. 9, 2005 in corresponding European Patent Application No. 04 02 4011.1.

* cited by examiner

*Primary Examiner*—Jila M Mohandesi
*Assistant Examiner*—Sharon M Prange
(74) *Attorney, Agent, or Firm*—Rissman Hendricks & Oliverio, LLP

(57) ABSTRACT

Package system (2) for a powdery, granular, paste-like or liquid sterile product comprising a plastic outer tray (4) and a plastic inner tray (6). The inner tray (6) is to be sealed with a first plastic cover to form a sterile receptacle for the sterile product. The outer tray (4) is to be sealed with a second plastic cover to form a sterile receptacle for the inner tray (6). The inner tray (6) has a spout (40) for the application of the sterile product.

16 Claims, 5 Drawing Sheets

PACKAGE SYSTEM FOR A POWDERY, GRANULAR, PASTE-LIKE OR LIQUID STERILE PRODUCT

FIELD OF THE INVENTION

The present invention relates to a package system for a sterile product, such as a powdery, granular, paste-like or liquid sterile product, to a plastic inner tray, a plastic outer tray and in inlay for such a package system, to a package unit comprising such a package system and to a method of delivering a sterile product from such a package system.

BACKGROUND OF THE INVENTION

Packages for sterile storage are used in various technical fields, such as in medicine or in the food industry. Particularly in medicine, receptacles for storing and dispensing a sterile product often have to be kept sterile too, to avoid contamination of, for example, the surgical environment.

Products used in surgery are generally applied sterilely. Such products are, for instance, bone regeneration materials used for supporting the regeneration of bone tissue in dental implant surgery. Several package systems for bone regeneration materials have been developed in the past, all belonging to one of the following three groups:

A first group relates to syringes having a tube in which the bone regeneration material is contained. The syringe is sterilely enclosed in a pouch. Examples of sterile products packaged in such a package system are CrossBone® of Biotech International or Biogran® of 3i.

In a second group, the package system is a glass vial sealed by a plastic stopper and an aluminum lid. The glass vial is sterilely enclosed in a pouch. Examples of sterile products packaged in such a package system are Bio-Oss® of Geistlich Biomaterials and Cerasorb® of Curasan.

In a third group, the package system comprises an outer tray and an inner tray, both having a bottom portion and a cylindrical sidewall. The bone regeneration material is contained in the inner tray sealed with a first cover, and the inner tray is contained in the outer tray sealed with a second cover. Such a package system is called a "double blister". An example of a sterile product packaged in such a package system is Ceros TCP® of Mathys Medical.

For applying the bone regeneration material contained in a "double blister", the cover of the outer tray is peeled off and the sealed sterile inner tray is removed from the outer tray, i.e. by dropping it on the sterile surface. Thereby, only the sterile inner tray comes into contact with the sterile surface. The cover of the inner tray is then peeled off and a liquid—typically a sterile physiological NaCl solution or blood, which has previously been taken from the patient—is added to the granular bone regeneration material. The thus formed mass is then discharged from the inner tray and applied.

Discharging and applying the said formed mass from a known "double blister" as described above is troublesome and time consuming, since the dentist has to spoon out the said formed mass from the inner tray with a spoon or a spatula. Thereby, a considerable amount of the said formed mass is usually spilled. Further, there is always a residue in a tray which cannot be spooned out. This also contributes to a considerable loss of bone regeneration material.

In addition, contamination of the sterile mass is likely due to its relatively long exposure to the environment.

SUMMARY OF THE INVENTION

In one aspect, the present invention is directed to providing a package system, such as a "double blister" package system, which allows for easy, fast and accurate application of a sterile product.

A package system for a powdery, granular, paste-like or liquid sterile product is provided comprising an outer plastic tray and an inner plastic tray, the inner tray to be sealed with a first plastic cover to form a sterile receptacle for the sterile product, and the outer tray to be sealed with a second plastic cover to form a sterile receptacle for the inner tray, wherein the inner tray has a spout for the application of the sterile product.

The term "spout" as used herein typically stands for an angle formed by two portions of the inner tray sidewall. It also encompasses any other means that serves the purpose of accumulating and discharging the sterile product to be applied.

Such a package system allows to provide a sterile product, e.g. a sterile bone regeneration material, in a receptacle which itself is sterile. The sterile product can be accumulated near the spout of the inner tray. It is then discharged from the spout of the inner tray. The sterile product to be discharged can be guided and moved continuously. The spout allows application of the sterile product on the precise site of treatment.

Since the product may be applied directly from the inner tray to the patient's wound, spilling of the product, as happens by spooning, is considerably reduced. Discharging and applying of the sterile product are simultaneous and the exposure of the sterile product to the environment is much shorter. Thus, the likelihood of the sterile product to be contaminated by the environment is vastly reduced.

In a preferred embodiment, the spout is formed by two portions of the inner tray sidewall intersecting with an angle of 10° to 90°, the inner tray sidewall being rounded in the region of the intersection. The spout of such an embodiment is optimally adapted to the dimension and shape of a dentist's conventional spoon or spatula which normally has a width of 3 mm to 6 mm.

More preferably, the angle is 30° to 60° and most preferably about 45°.

Preferably, the angle where the inner tray sidewall meets the inner tray bottom is about 90° or slightly greater than 90°. This allows accumulation of the sterile product near the spout before application.

The inner tray bottom generally has the shape of a polygon such as a triangle, a square, a rectangle, a rhomboid, a pentagon or a hexagon. It can also have the shape of an arrow or a tip of an arrow, a teardrop, half a teardrop, a heart, a segment of a circle or ellipse, a sector of a circle or ellipse, a sickle or a spindle.

It is preferable that the inner tray bottom has a triangular shape. In such an embodiment, the inner tray generally has three spouts. More preferably, the triangle has sides with different lengths. In such an embodiment, each of the three angles of the triangle are different and therefore the spouts are different. The sterile product can be applied by the most suitable of the three different spouts.

In a preferred embodiment, the inner tray has an inner tray rim for the fixing of the first plastic cover and the outer tray has an outer tray rim for the fixing of the second plastic cover. The rims allow the inner and the outer tray to be sealed with the respective plastic cover. The inner tray rim has preferably a width of about 5 mm and the outer tray rim has preferably a width of about 6 mm.

Preferably, at least a portion of the outer edge of the inner tray rim abuts against the outer tray sidewall, thereby preventing the inner tray from moving in parallel direction to the outer tray bottom.

Preferably, at least one of the trays of the package system has a peel tab for peeling off the plastic cover. The peel tab also provides an area at which the respective tray can be gripped.

The presence of a gap between the outer edge of the inner tray rim and the outer tray sidewall further allows the user to exert pressure on the rear side of the inner tray rim and thereby to lift and remove the inner tray from the outer tray.

In a particularly preferred embodiment, the package system of the present invention further comprises an inlay removably arranged within the inner tray in a force fitting manner, the inlay bottom and the inner tray bottom defining a space having a volume substantially corresponding to the volume of the sterile product to be packaged. The presence of such an inlay retains the sterile product in said space. This is of particular importance if the quality of the packaged product is impaired by abrasion caused by agitation. Agitation of bone regeneration materials, for example, may lead to a significant abrasion and thus to a considerable loss of its 3-D structure/morphology. Due to the inlay, a bone regeneration material packaged in such a preferred package system retains its initial 3-D structure/morphology even after subjecting the package system to vigorous agitation. Since the inlay is arranged in the inner tray in a force fitting manner, it does not move in respect to the inner tray when assembled.

In an even more preferred embodiment, the inlay has an inlay rim which at least partially rests on a recessed shoulder in the inner tray. Thus, the spacing between the inlay bottom and the inner tray bottom is clearly defined in the assembled package system. Since the inlay rim is recessed in respect to the inner tray rim, the inlay rim does not contact the plastic cover when sealing the inner tray.

More preferably, the inner tray sidewall has a bulge for lifting and removing the inlay from the inner tray. Such a bulge is called a "finger scoop". The lifting and removing of the inlay from the inner tray is achieved by exerting pressure on the rear side of the inlay rim facing the finger scoop. Pressure can for example be exerted by a finger or by means of a spoon or a spatula. The inlay rim preferably has a width of about 2 mm.

It is further preferred that the inlay bottom has substantially the same shape as the inner tray bottom.

In a package system as described containing the powdery, granular, paste-like or liquid sterile product, the sterile product is arranged within the sterile interior of the inner tray sealed with the first plastic cover and the inner tray is arranged within the sterile interior of the outer tray sealed with a second plastic cover.

In general, the plastic covers are sheetlike covers, e.g. foils. They are typically heat-sealed to the rim of the respective tray.

If the package system comprises an inlay, the volume of the sterile product substantially corresponds to the volume of the space defined by the inlay bottom and the inner tray bottom. Thus, it is packaged in a retained manner.

Since the sterile product will get contaminated after having been exposed to the environment for a certain period of time, it is preferable that the amount of the sterile product substantially corresponds to a single dose of use.

As given above, the powdery, granular, paste-like or liquid sterile product is preferably a bone regeneration material used for supporting the regeneration of bone tissue in dentistry. An example of such a bone regeneration material, for which the package of the present invention is particularly well suited, is Straumann Bone Ceramic. Straumann Bone Ceramic is a fully synthetic bone graft substitute of medical grade purity in particulate form. It is composed of biphasic calcium phosphate. The granules of Straumann Bone Ceramic are made from porous blocks. The pores are interconnected and 100 to 500 μm in diameter.

The powdery, granular, paste-like or liquid sterile product is filled in a RR class 10,000 environment. The bottled sterile bulk product is supplied to an appropriate weighing equipment, unsealed and put at the filling station. The inner tray is put on a balance under the filling station. The product is filled into the inner tray until the desired weight is reached. The inner tray is then sealed with a first foil in the RR class 10,000 environment and put into the outer tray. The outer tray is then sealed with a second plastic foil in the RR class 10'000 environment.

A further aspect of the invention relates to a plastic inner tray and a plastic outer tray for the package system. A further aspect relates to an inlay according to the above described preferred embodiment. The three components—plastic outer tray, plastic inner tray and inlay—are preferably made of PETG, a polyethylene terephthalate copolymer. They are preferably manufactured by deep-drawing methods. Preferably, all angles, edges and corners of the components of the package system are rounded in order to diminish the risk of injury.

In order to make the three components of the package system easily distinguishable, they may have different colours.

The first plastic cover sealing the inner tray is preferably made of coated high-density polymer fibers in foil form, such as Tolas® TPC-0810, and the second plastic cover sealing the outer tray is preferably made of high-density polymer fibers, such as Tyvek® SBP 2000 1073B.

Another aspect of the invention relates to a package unit comprising the packaged sterile product. The addition of any other sterile medicinal tool, such as a spoon or spatula, is also contemplated.

Apart from bone regeneration in dentistry, other fields of application, e.g. bone regeneration in orthopedic surgery, are contemplated.

BRIEF DESCRIPTION OF THE DRAWINGS

Various aspects of the invention will be further illustrated by way of the drawings, showing in FIG. 1 a perspective exploded view of a package system according to one embodiment of the present invention comprising an outer tray, an inner tray and an inlay.

DETAILED DESCRIPTION

Figure 1:
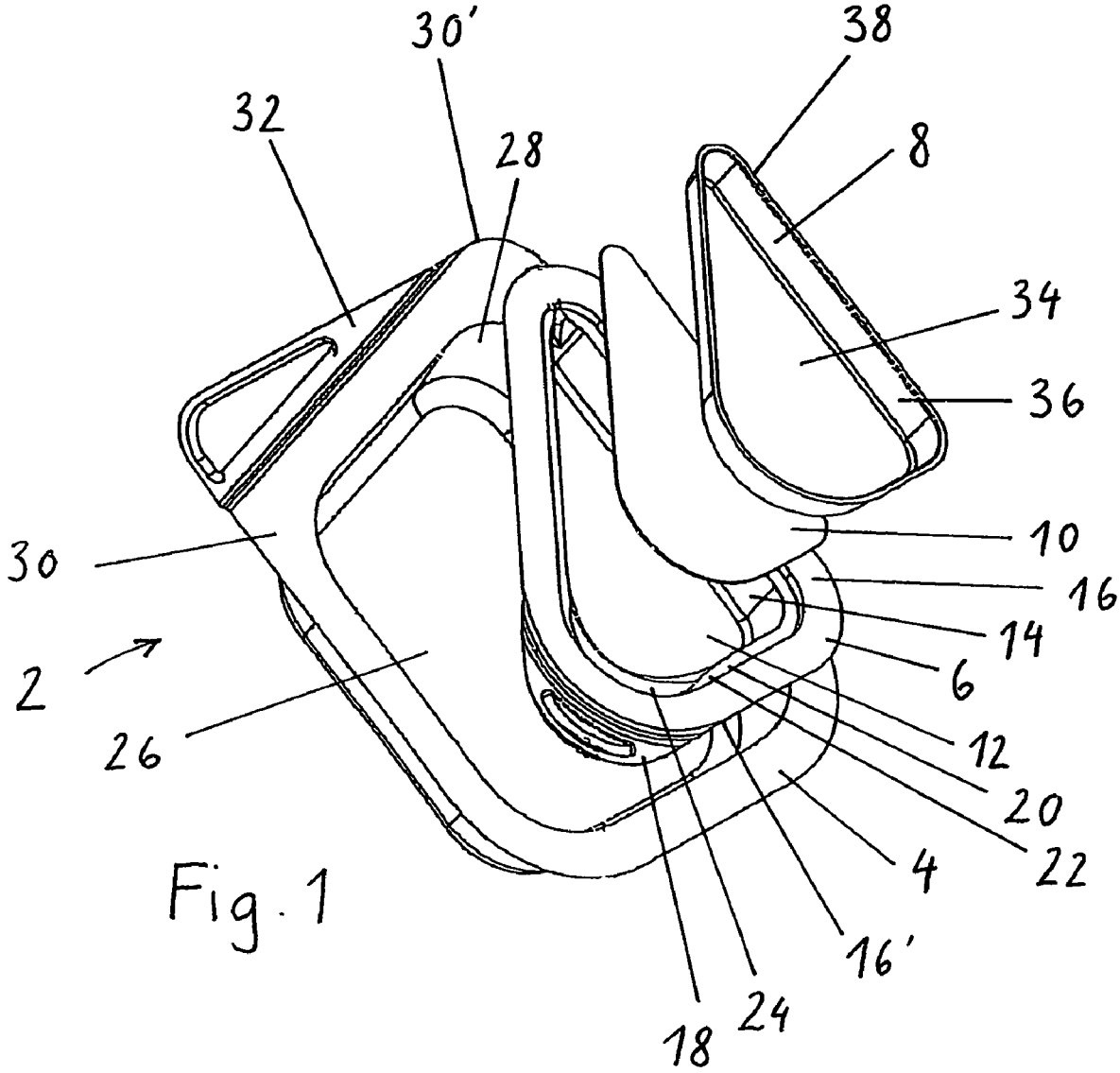

According to FIG. 1, the package system 2 of one embodiment comprises an outer tray 4, an inner tray 6 and an inlay 8. The outer tray 4, the inner tray 6 and the inlay 8 are formed of a uniformly thick plastic material.

The dimensions of the inner tray 6 are such that it fits within the outer tray 4 and the dimensions of the inlay 8 are such that it fits within the inner tray 6.

The inner tray 6 is to be sealed with a first plastic cover (not shown) to form a sterile receptacle for a sterile product (the volume 10 of which is schematically shown). The inner tray 6 comprises an inner tray bottom 12, a circumferential inner tray sidewall 14 and a circumferential inner tray rim 16 for the fixing of the first plastic cover. At the outer edge 16' of the inner tray rim 16, an inner tray peel tab 18 for peeling off the plastic cover is arranged. Near the inner tray rim 16, a circumferential recess 20 is arranged in the inner tray sidewall. Said circumferential recess forms a circumferential shoulder 22. In the inner tray sidewall 14 beneath the shoulder 22, a bulge 24 (called "finger scoop") is formed. The bulge 24 has the shape of a portion of a spherical segment.

The outer tray 4 is destined to be sealed with a second plastic cover (not shown) to form a sterile receptacle for the inner tray 6. The outer tray 4 comprises an outer tray bottom 26, a circumferential outer tray sidewall 28 and a circumferential outer tray rim 30. At the outer edge 30' of the outer tray rim 30, an outer tray peel tab 32 is arranged.

The inlay 8 comprises an inlay bottom 34, an inlay sidewall 36 and an inlay rim 38.

Figure 2:
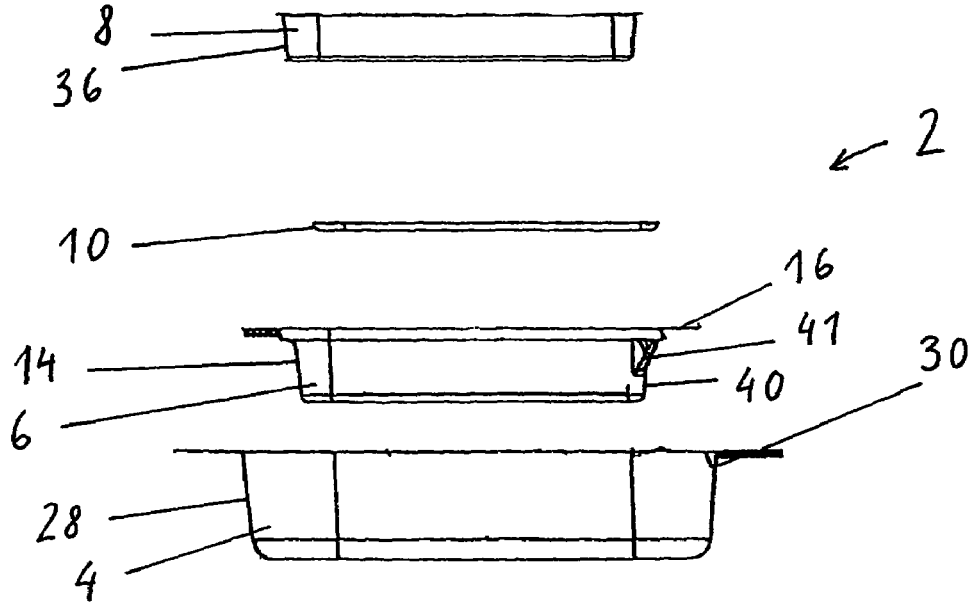
FIG. 2 a lateral exploded view of the package system shown in FIG. 1.

As seen in FIG. 2, the outer tray sidewall 28 is higher than the inner tray sidewall 14. Thus, if the inner tray 6 is arranged within the outer tray 4, the plane of the inner tray rim 16 is recessed in respect to the plane of the outer tray rim 30. The height of the inlay sidewall 36 is such that when arranged in the inner tray 6, the inlay bottom 34 and the inner tray bottom 12 form a space having a volume which substantially corresponds to the volume 10 of the product to be packaged.

In the inner tray sidewall 14, a spout 40 is formed. In the region of the spout 40, a projection 41 may be formed beneath the inner tray rim 16.

Figure 3:
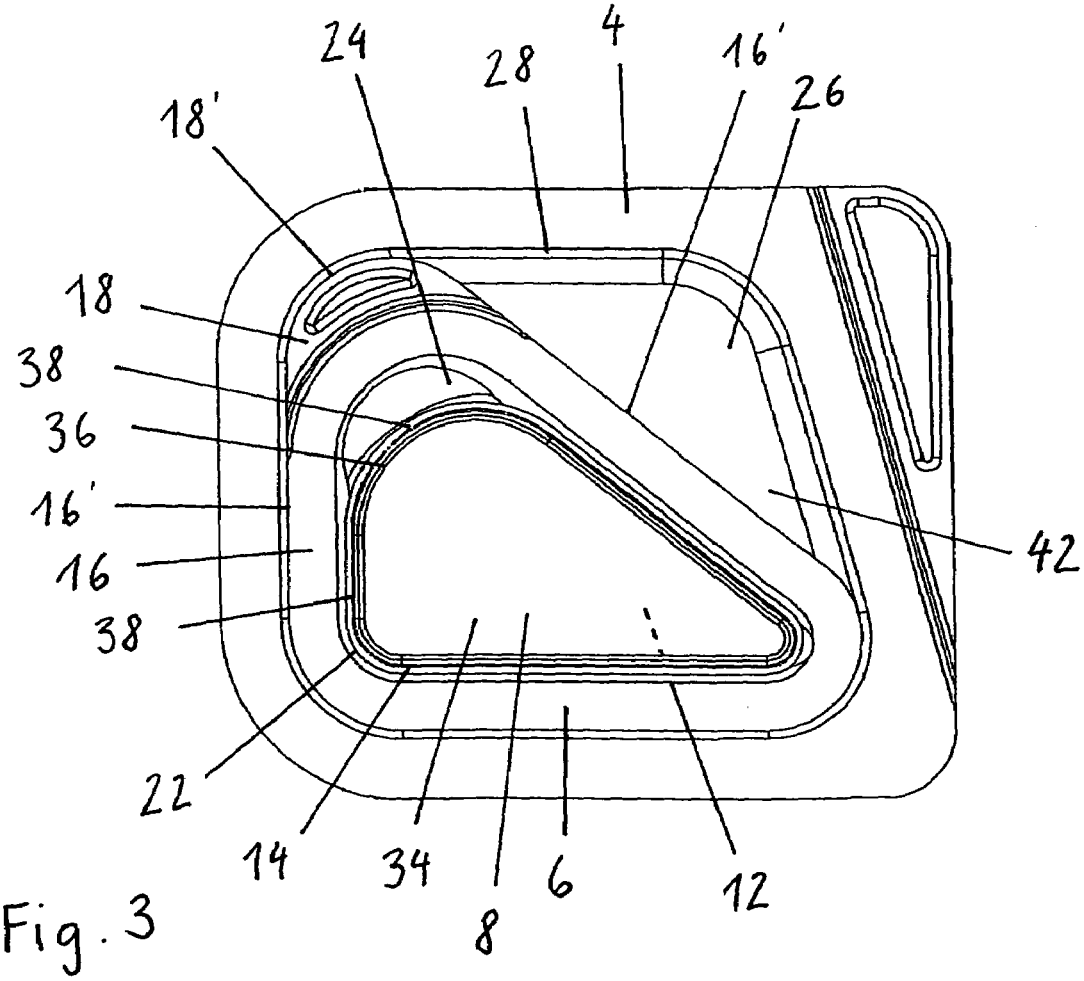
FIG. 3 a plane view of the package system shown in FIGS. 1 and 2, the package system being assembled.

According to FIG. 3, the outline of the outer tray 4 has the shape of a tetragon with rounded angles and the outline of the inner tray 6 arranged within the outer tray 4 has the shape of a triangle with rounded angles. A portion of the free outer edge 16' of the inner tray rim 16 and of the free outer edge 18' of the inner tray peel tab 18 abuts against the outer tray sidewall 28. Thereby, the inner tray 6 is prevented from moving in a direction parallel to the outer tray bottom 26. Further, a triangular gap 42 is formed between the outer edge 16' of the inner tray rim 16 and the outer tray sidewall 28. Said gap 42 allows the user to lift the inner tray 6 out of the outer tray 4.

The inlay 8 is arranged in the inner tray 6. The inlay bottom 34 has substantially the same shape as the inner tray bottom 12, i.e. the shape of the half of a teardrop. A portion of the inlay rim 38 rests on the recessed shoulder 22 of the inner tray sidewall 14. A portion of the inlay sidewall 36 abuts against the inner tray sidewall 14. Thus, the inlay 8 is arranged in the inner tray 6 in a force fitting manner. In the region of the bulge 24 of the inner tray sidewall 14, the inlay sidewall 36 is exposed. Likewise, the inlay rim 38 in said region does not rest on the recessed shoulder 22. Thereby, the inlay 8 can be lifted out of the inner tray 6 by exerting pressure to the rear side of the inlay rim 38 facing the bulge 24.

Figure 4:
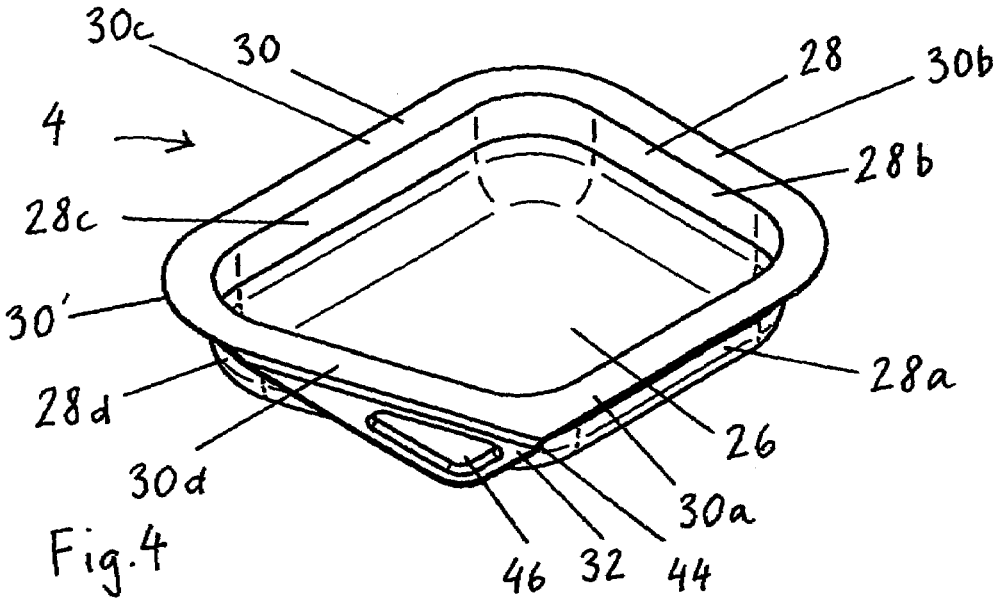
FIG. 4 a perspective view of an outer tray for a package system similar to the one shown in FIGS. 1 to 3.

FIG. 4 shows the plastic outer tray 4 of a package system 2 similar to the one shown in FIGS. 1 to 3. The outer tray 4 has an outer tray bottom 26, a circumferential outer tray sidewall 28 and a circumferential outer tray rim 30. The outer tray sidewall 28 consists of four outer tray sidewall portions 28*a*, 28*b*, 28*c*, 28*d* and the outer tray rim 30 consists of four outer tray rim portions 30*a*, 30*b*, 30*c*, 30*d*. All angles of the outer tray sidewall 28 and the outer tray rim 30 are rounded. The outer tray peel tab 32 is arranged at the outer edge 30' of the outer tray rim 30. Between the outer tray rim 30 and the outer tray peel tab 32, a transitional region 44 is formed. The outer tray peel tab 32 comprises an embossed portion 46.

Figure 5:
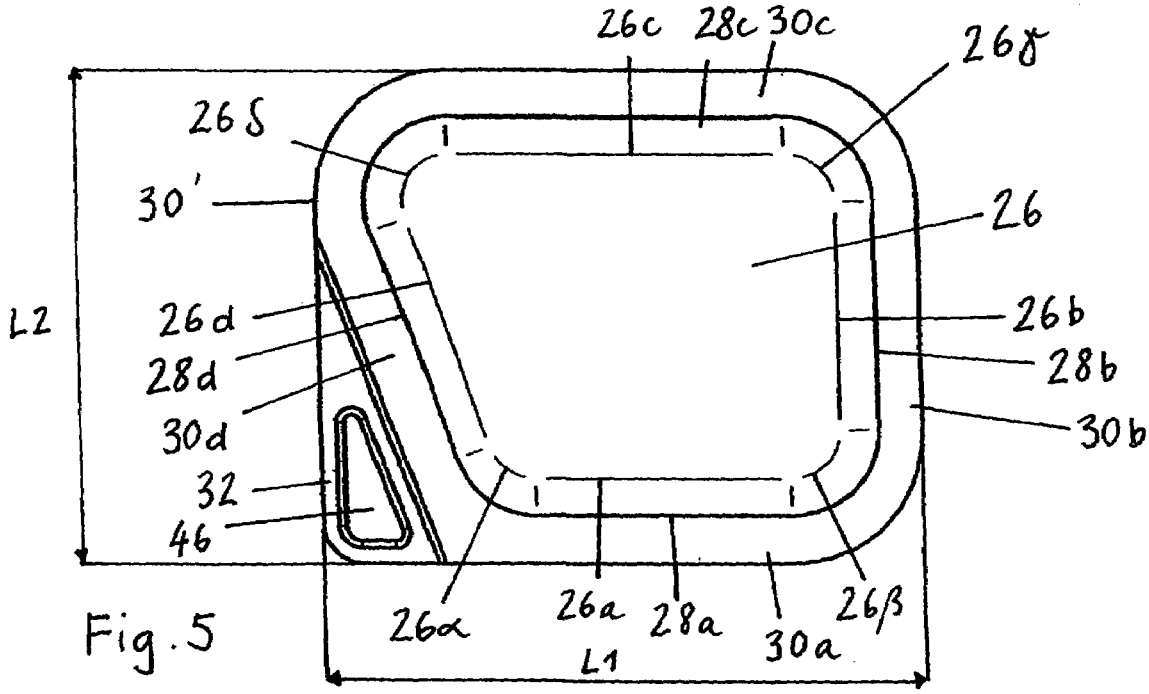
FIG. 5 a plane view of the outer tray shown in FIG. 4.

According to FIG. 5, the outer tray bottom 26 has substantially the shape of tetragon with rounded angles. Sides 26*a* and 26*c* of the tetragon run parallel and side 26*b* runs perpendicular to side 26*a* and side 26*c*. Sides 26*a* and 26*b* form angle 26β and sides 26*b* and 26*c* form angle 26γ. Angle 26δ formed by sides 26*c* and 26*d* is about 80° and angle 26α formed by sides 26*d* and 26*a* is about 100°. The outer tray sidewall portions 28*a*, 28*b*, 28*c* and 28*d* correspond to sides 26*a*, 26*b*, 26*c* and 26*d* of the tetragon. The outer tray rim 30 consists of four outer tray rim portions 30*a*, 30*b*, 30*c*, 30*d* corresponding to sides 26*a*, 26*b*, 26*c* and 26*d* of the bottom 26. The outer tray rim 30 has a substantially uniform width. The outer tray peel tab 32 is arranged at the outer tray rim portion 30*d*. The outer tray peel tab 32 has substantially the shape of a right triangle with the right angle being rounded. The embossed portion 46 of the outer tray peel tab 32 has a triangular shape substantially corresponding to the shape of the outer tray peel tab 32 but with all angles being rounded. The free outer edge 30' of the outer tray rim 30 together with the free outer edge 32' of the outer tray peel tab 32 form an outline having the shape of a rectangle with rounded angles. The long side L1 of the rectangle is about 85 mm and the short side L2 of the rectangle is about 69 mm. The rectangle can have any other dimensions.

Figure 6:
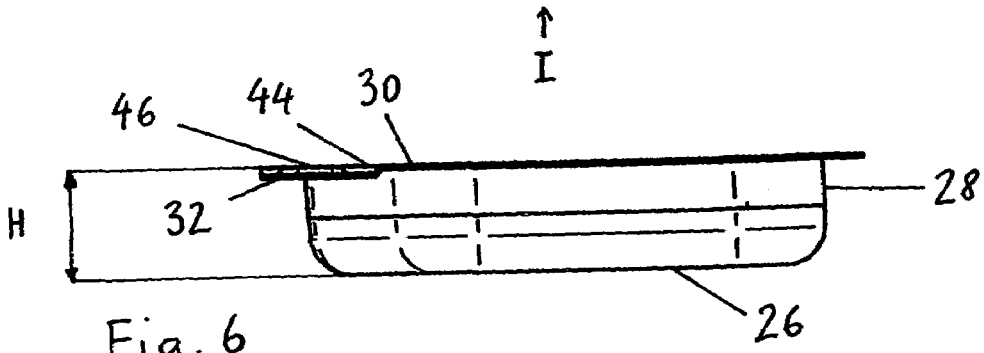
FIG. 6 a side view of the outer tray shown in FIGS. 4 and 5 along direction I according to FIG. 5.

As seen from FIG. 6, the outer tray sidewall 28 arises substantially perpendicular from the outer tray bottom 26. The outer sidewall 28 is rounded where it meets the outer tray bottom 26. The outer tray rim 30 protrudes from the outer tray sidewall 28 in a direction substantially parallel to the outer tray bottom 26. The outer tray 4 has a height H of about 15 mm, but any other height is contemplated.

The transitional region 44 arranged between the outer tray peel tab 32 and the outer tray rim 30 is inclined downwards. Thus, the plane of the outer tray peel tab 32 is recessed in respect to the plane of the outer tray rim 30. The embossed portion 46 of the outer tray peel tab 32 forms a plane which substantially coincides with the plane of the outer tray rim 30.

Figure 7:
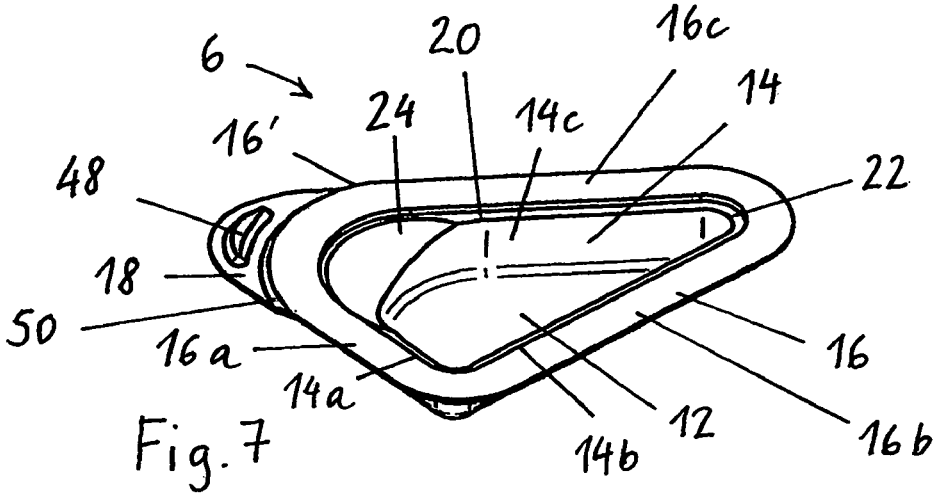
FIG. 7 a perspective view of an inner tray adapted to the outer tray of FIGS. 4 to 6.

FIG. 7 shows an inner tray 6 having an inner tray bottom 12, a circumferential inner tray sidewall 14 and a circumferential inner tray rim 16. The inner tray sidewall 14 consists of three inner tray sidewall portions 14*a*, 14*b*, 14*c* and the inner tray rim 16 consists of three inner tray portions 16*a*, 16*b*, 16*c*. The inner tray peel tab 18 is arranged at the outer edge 16' of the inner tray 16 in the region where inner tray portion 16*a* and 16*c* meet. The inner tray peel tab 18 comprises an embossed portion 48 which is kidney-shaped. The transitional region 50 arranged between the inner tray rim 16 and the inner tray peel 18 tab is inclined downwards. Thus, the plane of the inner tray peel tab 18 is recessed in respect to the plane of the inner tray rim 16. The embossed portion 48 of the inner tray peel tab 18 forms a plane which substantially coincides with the plane of the inner tray rim 16.

Near the inner tray rim 16, the circumferential recess 20 is formed in the inner tray sidewall 14, said recess 20 forming the circumferential shoulder 22. The plane of said shoulder 22 runs in a direction substantially parallel to the plane of the inner tray bottom 12. Beneath the circumferential shoulder 22 the bulge 24 ("finger scoop") is formed in the inner tray sidewall 14.

Figure 8:
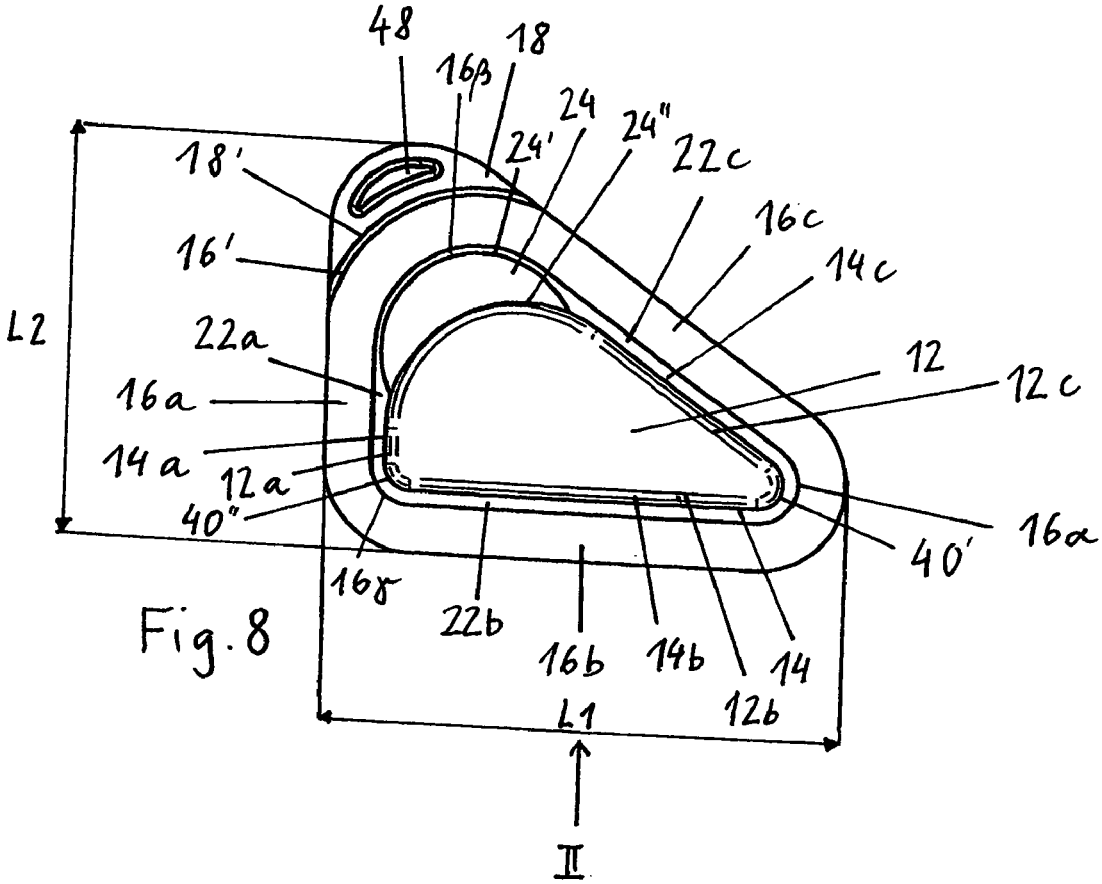
FIG. 8 a plane view of the inner tray shown in FIG. 7.

As seen from FIG. 8, the inner tray bottom 12 has the shape of the half of a teardrop, the angles being rounded. The outline of the inner tray bottom 12 comprises three portions 12*a*, 12*b*, 12*c*, the curvature of the teardrop being arranged between portion 12*a* and 12*c*. Likewise, the inner tray sidewall 14 substantially comprises three inner tray sidewall portions 14*a*, 14*b*, 14*c*. Inner tray sidewall portions 14*b* and 14*c* intersect with an angle of about 35°, thereby forming a first spout 40'. Inner tray sidewall portions 14*a* and 14*b* intersect with an angle of about 90°, thereby forming a second spout 40". In the region of the spouts 40', 40", the inner tray sidewall 14 is rounded.

The inner tray rim 16 has a uniform width. The outline of the three inner tray rim portions 16*a*, 16*b*, 16*c* form the shape of a right triangle. The angles are rounded. Corresponding to the spouts 40', 40", angle 16α (formed by inner tray rim portions 16*b* and 16*c*) is about 35° and angle 16γ (formed by inner tray rim portions 16*a* and 16*b*) is about 90°. Consequently, angle 16β (formed by inner tray rim portions 16*a* and 16*c*) is about 55°. Adapted to the dimensions of the outer tray 4 (see FIG. 4 to 6), L1 of the inner tray 6 is about 72 mm and L2 is about 56 mm. Other dimensions are contemplated.

The inner tray peel tab 18 is arranged at the region of the inner tray rim 16 where inner tray rim portions 16*a* and 16*c* meet. The inner tray peel tab 18 has the shape of a sickle, the concave edge 18' of the sickle being joined to the outer edge 16' of the inner tray rim 16.

The circumferential shoulder 22 consists of three portions 22*a*, 22*b*, 22*c* corresponding to the inner tray rim portions 16*a*, 16*b*, 16*c*. Beneath the region of the shoulder where portions 22*a* and 22*c* meet, the bulge 24 is formed. Said bulge 24 has the shape of a portion of a spherical surface, the convex side 24' facing the inner tray rim 16 and the concave side 24" facing the inner tray bottom 12. Between the concave side 24" of the bulge 24 and the inner tray bottom 12, the curvature of the inner tray sidewall portion 14 runs parallel to the inner tray bottom 12. Since both the inner tray peel tab 18 and the bulge 24 are formed away from the spouts 40', 40", they do not interfere with the discharging and the application of the packaged product.

Figure 9:
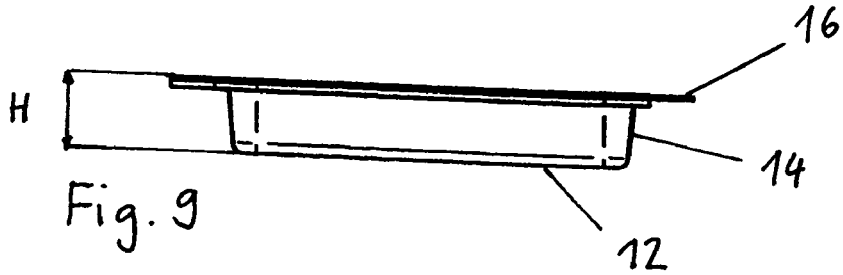
FIG. 9 a side view of the inner tray shown in FIGS. 7 and 8 along direction II according to FIG. 8.

As seen from FIG. 9, the inner tray sidewall 14 and the inner tray bottom 12 form an angle slightly greater than 90°. The inner tray sidewall 14 is rounded where it meets the inner tray bottom 12. The inner tray rim 16 protrudes from the inner tray sidewall 14 in a direction substantially parallel to the inner tray bottom 12.

Adapted to the height of the outer tray 4 (see FIG. 6), the inner tray 6 has a height H of about 10 mm. Any other height is contemplated.

Figure 10:
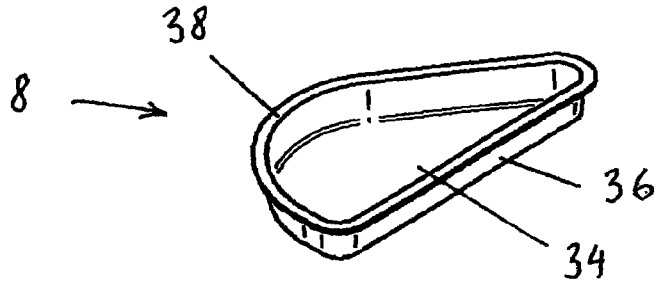
FIG. 10 a perspective view of an inlay adapted to the inner tray shown in FIGS. 7 to 9.

The inlay 8 as shown in FIG. 10 comprises an inlay bottom 34, a circumferential inlay sidewall 36 and a circumferential inlay rim 38.

Figure 11:
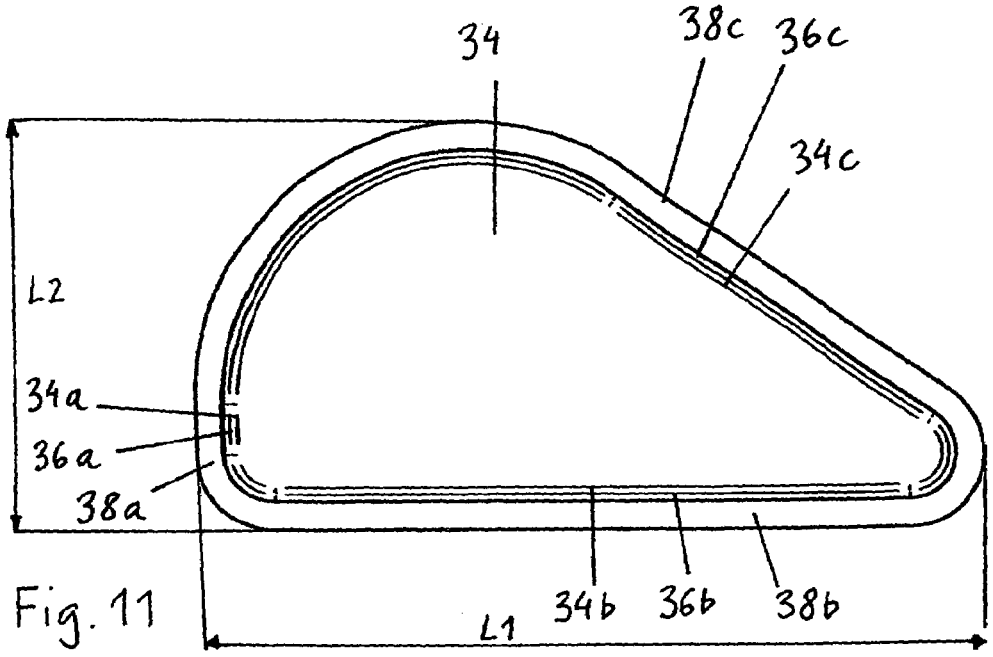
FIG. 11 a plane view of the inlay shown in FIG. 10.

As also seen in FIG. 11, the shape of the inlay bottom 34 substantially corresponds to the shape of the inner tray bottom 12 according to FIGS. 7 to 9, and consequently has the shape of the half of a teardrop with three inlay bottom portions 34*a*, 34*b*, 34*c*. Likewise, the inlay sidewall 36 has three inlay sidewall portions 36*a*, 36*b*, 36*c* and the inlay rim 38 has three inlay rim portions 38*a*, 38*b*, 38*c* corresponding to the inlay bottom portions 34*a*, 34*b*, 34*c* and thus to the inner tray bottom portions 12*a*, 12*b*, 12*c* (see FIGS. 7 and 8). All angles of the inlay sidewall 36 and the inlay rim 38 are rounded. The dimensions of the inlay bottom 34 are slightly smaller than the dimensions of the inner tray bottom 12. Thus, in the assembled package system the inlay 8 is arranged in the inner tray 6 in a force fitting manner, since the inlay sidewall 36 abuts against the inner tray sidewall 14.

The inlay rim 38 has a substantially uniform width. The width is such that it fits into the recess 20 of the inner tray sidewall 14 (see FIGS. 7 and 8). Thus, in the assembled package system the inlay rim 38 rests on the shoulder 22 of the inner tray 6.

Adapted to the dimensions of the inner tray 6, L1 of the inlay 8 is about 58 mm and L2 is about 30 mm. Other dimensions are contemplated.

Figure 12:
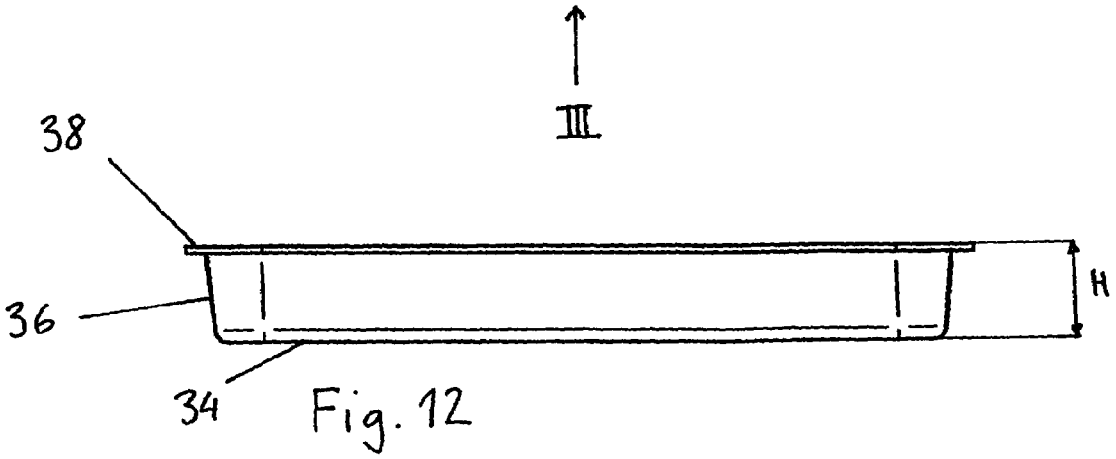
FIG. 12 a side view of the inlay shown in FIGS. 10 and 11 along direction III according to FIG. 11.

According to FIG. 12, the inlay sidewall 36 and the inlay bottom 34 form an angle slightly greater than 90°. The inlay sidewall 36 is rounded where it meets the inlay bottom 34. The inlay rim 38 protrudes from the inlay sidewall 36 in a direction substantially parallel to the inlay bottom 34.

The inlay 8 has a height of about 7 mm. Depending on the height of the inner plastic tray 6, any other height is contemplated.

The invention claimed is:

1. A method of delivering a sterile product from a package system comprising:

providing a plastic package comprising a plastic inner tray having a discharge spout and sealed by a first plastic cover forming a sterile receptacle containing a powdery, granular, paste-like or liquid sterile product, wherein the discharge spout is shaped to accumulate and guide the powdery, granular, paste-like or liquid sterile product for simultaneous discharge and direct application of the product from the inner tray to the treatment site, and a plastic outer tray having a second plastic cover to form a sterile receptacle for the inner tray, and wherein the volume of the sterile product substantially corresponds to the volume of the space defined by the inner tray bottom and a bottom of an inlay removably arranged within the inner tray;

removing the second plastic cover from the outer tray to enable removal of the sealed inner tray, removing the first plastic cover from the inner tray, and simultaneously discharging and directly applying the sterile product from the spout of the inner tray to the treatment site.

2. The method of claim 1, wherein the spout is formed by two portions of the inner tray sidewall intersecting with an angle of 10° to 90°, the inner tray sidewall being rounded in the region of the intersection.

3. The method of claim 2, wherein the spout is formed by two portions of the inner tray sidewall intersecting with an angle of 30° to 60°.

4. The method of claim 3, wherein the spout is formed by two portions of the inner tray sidewall intersecting with an angle of about 45°.

5. The method of claim 1, wherein the inner tray bottom has substantially a triangular shape.

6. The method of claim 5, wherein each side of the triangle has a different length.

7. The method of claim 1, wherein the inner tray has an inner tray rim for the fixing of the first plastic cover and the outer tray has an outer tray rim for the fixing of the second plastic cover.

8. The method of claim 7, wherein at least a portion of the outer edge of the inner tray rim abuts against the outer tray sidewall, thereby preventing the inner tray from moving in parallel direction to the outer tray bottom.

9. The method of claim 1, wherein at least one of the trays has a peel tab.

10. The method of claim 1, wherein discharge spout has a width of 3 mm to 6 mm.

11. The method of to claim 1, wherein the amount of the sterile product substantially corresponds to a single dose.

12. The method of claim 1, wherein the sterile product is a bone regeneration material.

13. A method of delivering a sterile product from a package system comprising:

providing a plastic package comprising a plastic inner tray having a discharge spout and sealed by a first plastic cover forming a sterile receptacle containing a powdery, granular, paste-like or liquid sterile product, wherein the discharge spout is shaped to accumulate and guide the powdery, granular, paste-like or liquid sterile product for simultaneous discharge and direct application of the product from the inner tray to the treatment site, and a plastic outer tray having a second plastic cover to form a sterile receptacle for the inner tray, and an inlay removably arranged within the inner tray in a force fitting manner, the inlay bottom and the inner tray bottom defining a space having a volume substantially corresponding to the volume of the sterile product, removing the second plastic cover from the outer tray to enable removal of the sealed inner tray, removing the first plastic cover from the inner tray, and simultaneously discharging and directly applying the sterile product from the spout of the inner tray to the treatment site.

14. The method of claim 13, wherein the inlay has an inlay rim which at least partially rests on a recessed shoulder in the inner tray.

15. The method of claim 13, wherein the inner tray sidewall has a bulge for lifting and removing the inlay from the inner tray.

16. The method of claim 13, wherein the inlay bottom has substantially the same shape as the inner tray bottom.

* * * * *

UNITED STATES PATENT AND TRADEMARK OFFICE

CERTIFICATE OF CORRECTION

PATENT NO. : 7,721,890 B2
APPLICATION NO. : 11/246352
DATED : May 25, 2010
INVENTOR(S) : Astrid Neidhardt It is certified that error appears in the above-identified patent and that said Letters Patent is hereby corrected as shown below:

Column 9, line 5, "wherein discharge" should be -- wherein the discharge --.

Column 9, line 7, delete "to".

Signed and Sealed this

Seventeenth Day of August, 2010

David J. Kappos

David J. Kappos
*Director of the United States Patent and Trademark Office*